US005134833A

United States Patent [19]

Lerner et al.

[11] Patent Number: 5,134,833

[45] Date of Patent: Aug. 4, 1992

[54] PACKAGING MACHINE & METHOD

[75] Inventors: Hershey Lerner, Aurora; Rick S. Wehrmann, Hudson, both of Ohio

[73] Assignee: Automated Packaging Systems, Inc., Twinsburg, Ohio

[21] Appl. No.: 612,098

[22] Filed: Nov. 13, 1990

Related U.S. Application Data

[63] Continuation-in-part of Ser. No. 351,702, May 12, 1989, Pat. No. 4,969,310.

[51] Int. Cl.[5] ..... B65B 51/20

[52] U.S. Cl. ..... 53/468; 53/373.4; 53/373.9; 493/191

[58] Field of Search ..... 53/479, 477, 370.9, 53/370.8, 373.9, 373.8, 373.5, 373.4, 505, 506; 493/191, 134

[56] References Cited

U.S. PATENT DOCUMENTS 2,272,251 2/1942 Robinson .
3,286,433 11/1966 Johnson et al. .
3,488,244 1/1970 Lepisto ..... 53/373.9 X
3,618,286 11/1971 Membrino ..... 53/373.4 X
3,720,565 3/1973 Cavanna ..... 53/373.9 X
3,785,255 1/1974 Talbot et al. ..... 493/134 X
4,201,031 5/1980 Wiles ..... 53/455
4,848,064 7/1989 Lems et al. ..... 53/459

*Primary Examiner*—James F. Coan
*Attorney, Agent, or Firm*—Watts, Hoffmann, Fisher & Heinke

[57] ABSTRACT

A machine and method for loading bags of a preformed web of side interconencted bags. The top of a bag web is slit open and then fed between a pair of belt conveyors. The tops of the bags projecting over the conveyors belts are folded down over them and then gripped by a second pair of conveyor belts. At a load station the belts are spread to open bags sequentially and one at a time for loading. After loading a bag is separated from the web and fed through a sealing section comprising two pairs of hot air cartridges which are movable such that they do not emit hot air into the path of bag travel when it is undesirable to do so and a pair of crimp rollers.

16 Claims, 3 Drawing Sheets

PACKAGING MACHINE & METHOD

This is a continuation-in-part of application Ser. No. 07/351,702, filed May 12, 1989, entitled Packaging Machine and Method, now U.S. Pat. No. 4,969,310.

TECHNICAL FIELD

This invention relates to packaging machinery and more particularly to machine and method which are especially well suited for loading relatively bulky and liquid products sequentially and one at a time into bags of a side interconnected chain of bags.

BACKGROUND OF THE INVENTION

The use of preopened bags, typically sold in roll form, for packaging products is now well known. Such bags are disclosed and claimed in now expired U.S. Pat. No. 3,254,828 entitled *Flexible Container Strips* issued Jun. 7, 1966 to Hershey Lerner. The product disclosed in that patent has been sold commercially by Automated Packaging System, Inc. of Twinsburg, Ohio under the trademark Autobag for many years.

With a properly made Autobag product, the face of each bag is open from side bead seal to side bead seal while the back of the bag is connected seal to seal to the next succeeding bag in the chain. The connection is by a line of weakness in the form of perforations which permits facile separation of a loaded bag.

Where a bulky product is inserted in such a bag the face of the bag tends to distort and sag while the back of the bag being connected seal to seal does not. In order to produce an attractive and quality finished product, a number of steps have been taken to bring the face of the bag into registration in the back. Steps which have been used commercially include a bag deflator mechanism as disclosed in U.S. Pat. No. 3,861,113 issued Jan. 21, 1975 to H. Hampton Loughry entitled *Packaging Apparatus and Method* and a bag support as disclosed in U.S. Pat. No. 3,956,866 issued May 18, 1976 to Vincent Lattur.

While the Autobag product has enjoyed great commercial success, there are applications where the product is not fully satisfactory. For example where it is desirable to provide a recloseable bag Autobag products are not readily producible because the reclosure is typically transverse of the bag. Since Autobag products travel in a longitudinal direction during manufacture transverse reopenable capabilities are difficult to provide.

An example of an application where a recloseable feature is desired is the packaging of panty hose which typically must be "stuffed" into a bag. Another reason Autobag products are not fully satisfactory for panty hose is if one stuffs a bulky product into a bag of the Autobag type using, for example, a machine which is sold commercially under the designation H-100 such as the machine shown in U.S. Pat. No. 3,965,653 issued Jun. 29, 1976 to Bernard Lerner, the force of stuffing the product into the bag tends to separate the back of the bag from the succeeding bag along the line of weakness. Further, the opening through which the product has been stuffed is forced into a generally circular configuration which makes appropriate closing and sealing quite difficult.

The use of preformed bags interconnected in side by side relation have been proposed for loading relatively bulky products. According to this proposal each bag of the chain has a side to side through opening at its top for guiding the chain of bags along a mandrel to a conveyor section. A knife is positioned intermediate the conveyor section and the mandrel for opening the bags. Bags once opened are conveyed to a load station where sequentially and one at a time they are brought to rest in the load station. The open top is spread and a product is inserted. Once the product has been inserted the machine cycles to bring the next bag of the chain to the load station and the loaded bag is transported to a seal station.

The prior proposal had several drawbacks which included the intermittent motion required sealing and loading to occur concurrently. Accordingly the machine could cycle no faster than the time required to load a package or the time required to affect a seal, which ever was the slower. The mechanism for transporting the bags also served to be the mechanism which resisted applied bag loading forces and accordingly was a limiting factor on the amount of force that could be applied in loading a bag rather than the strength of the bag so limiting the force.

The proposed machine had a load station with a single size opening which limited the machine's use to bags of but a single size. Further no adequate provision was made for separating bags from the web reliably and consistently both in the form of partial separation prior to bag loading and complete separation after a bag was loaded.

Another problem with prior proposals involved the manner in which the loaded bags were sealed. Heated platens have been utilized by some proposals and hot air cartridges which blow hot air onto the loaded bags while they are being sealed have been utilized by others. With heated platens, Teflon® belts must be utilized throughout the sealing section to prevent the heated plastic bag from adhering to the belts. The seals produced by the platens have an unsealed portion at the top of the bag which must be trimmed and even after the trimming, a portion of unsealed plastic typically remains.

When loaded bags are not moving through the sealing section, the heat radiating from the platens or the hot air emitted by the hot air cartridges deteriorates the conveyor belts. If the machine is down for any reason, the platens or hot air cartridges must be turned off to prevent deterioration of the belts. When the machine is ready to run again, it must wait for the platens or the hot air cartridges to reach the proper temperature.

SUMMARY OF THE DISCLOSURE

The machine made in accordance with the present invention includes a supply of preformed and side interconnected bags. A bag which is preferred for many applications is described more fully in application Ser. No. 07/500,000 filed Mar. 26, 1990 entitled *Reclosable Bag and Method of Making.* The bags are fed from the supply into a cyclical section where the bags are opened and sequentially and one at a time loaded. Thereafter a loaded bag is separated from the chain and passed through a continuous section where it is sealed.

Once the bag is loaded, fingers allow bag closing and the bag is transported to a conveyor of the continuous section.

Operation of the conveyor of the continuous section separates the loaded bag from the chain when intermittent travel is stopped. The continuous belt conveyor transports the loaded bag through the continuous section including passing through a sealing station in the continuous section and thence to a discharge.

At the input end of the belt conveyor of the continuous section there are a pair of moveable pulleys. Each pulley is mounted on an associated pulley moving mechanism that is controlled by a controller that also controls an intermittent section. When the intermittent section stops and a bag has been positioned at the load station the moveable pulleys are moved away from the path of travel. This movement releases the bag to be loaded from the continuous section and allows a retraction action to move the leading edge of the bag to be loaded as it is spread.

After a bag has been loaded and as it is closed, the moveable pulleys are brought in to grasp the now loaded bag and move it into the continuous section for sealing and discharge. As the intermittent section completes its indexing and the next bag to be loaded is moved into the load station and stops, the continued motion of the continuous section separates the loaded bag from the chain.

A novel and improved heat seal system provides a feature of the machine of this invention. The heat seal system has two pairs of movable hot air cartridges. The hot air cartridges are capable of moving to selectively deliver heated air either toward or away from the path of bag travel. When the machine is up and running, the hot air cartridges are positioned to blow hot air into the path of bag travel. If the machine is down for any reason, the hot air cartridges are shifted to a storage position in which they blow the hot air away from the path of bag travel to avoid blowing damaging hot air onto the belts of the continuous section.

A thermocouple is provided to sense the temperature of the air emitted by the hot air cartridges. The thermocouple together with the positioning capability of the cartridges allows the air output of the cartridges to be maintained at a constant temperature at all times during machine operation thereby providing seals of uniform quality and avoiding delays upon any restartup of the machine.

The hot air heats the plastic exposed above the conveyor belt to close to a thermo-molten state thereby fusing the plastic. The bag is then moved through a pair of crimping rollers which crimp and cool the plastic to form a seal. The seal is wider and more attractive than a seal created with heated platens. There is no portion of the seal which needs to be trimmed.

With the present invention, the Teflon® belts used with the platen sealers of the parent application are eliminated. The heated plastic is located above the conveyor belts and is not compressed against belts in the region where sealing is accomplished.

Accordingly, an object of this invention is to provide a novel and improved packaging machine and a method of packaging products.

DETAILED DESCRIPTION

Figure 1:
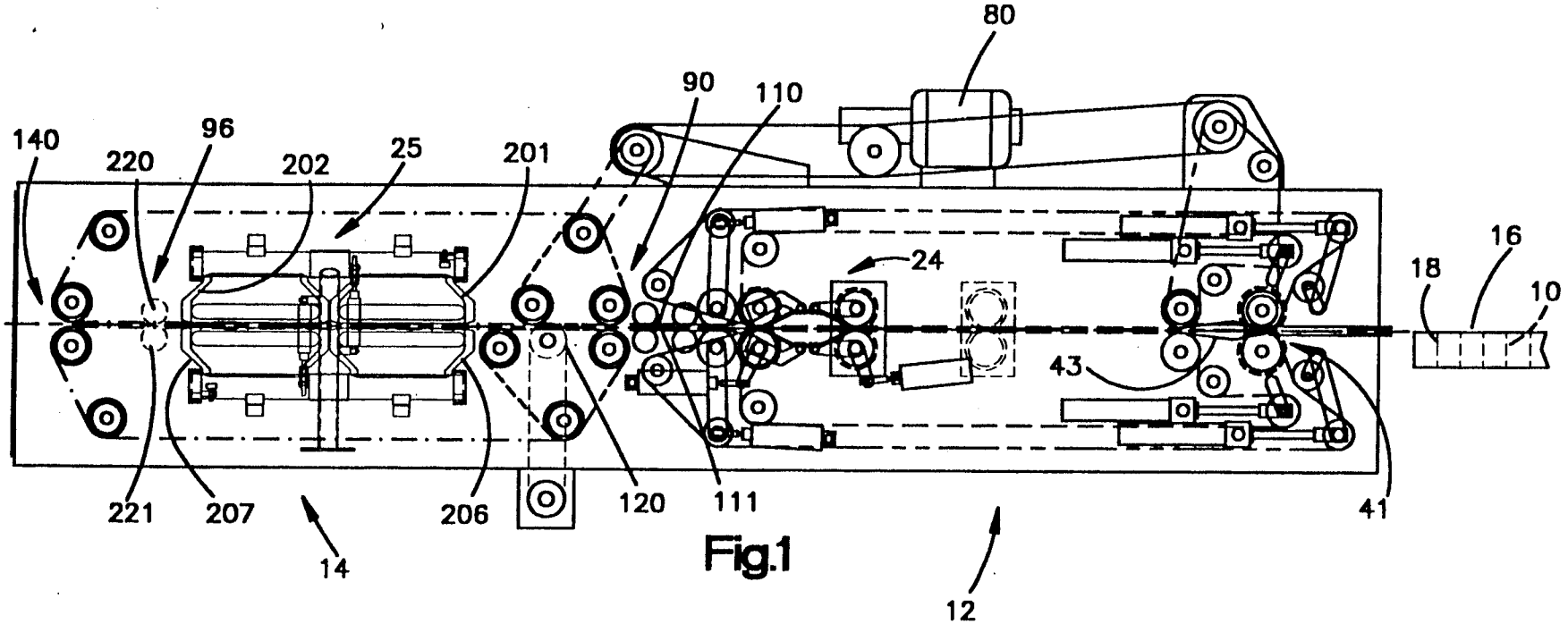
FIG. 1 is a somewhat schematic elevational view of the packaging machine of this invention.

Referring to the drawings and to FIG. 1 in particular a bag supply is shown generally at 10. The machine has intermittent and continuous sections 12, 14.

A chain of interconnected bags 16 is fed from a supply 10. The bags are interconnected in side by side relationship by frangible interconnections 18.

The chain of bags is fed horizontally into and through the intermittent section 12. The intermittent section 12 includes a loading station shown generally at 24 where products are inserted into the bags sequentially one bag at a time. The intermittent section 12 is preferably of a type as described more fully in parent application Ser. No. 07/351,702, filed May 12, 1989, entitled Packaging Machine and Method, now U.S. Pat. No. 4,969,310 which is incorporated in its entirety herein by reference. Loaded bags are transported from the intermittent section 12 into the continuous section 14. The continuous section 14 includes a sealer station shown generally at 25 where loaded bags are sealed. Thereafter the loaded and sealed bags are discharged from the machine.

Once the machine has been set up, the machine is turned on and prepared to cycle automatically. The motor 80 operates the entire machine.

The chain of bags is fed horizontally into and through the intermittent section 12 along a work transport path. As the bags move through the intermittent section 12, a knife 41 slits the bags along their tops to provide bag face and the back upstanding lips. A plow 43 folds open the lips. The lips are held open and a product is inserted into the bag.

A pair of continuous belt conveyors are indicated generally at 90, FIG. 1. These conveyors grasp a loaded bag at a time when the intermittent section is at rest and loading another bag. The grasping of the loaded bag by the conveyors 90 results in rupturing of the upper frangible inter-connection 16 separating the loaded bag for movement into the continuous section.

Belts of the conveyors 90 include reaches 110, 111 which define a continuation of the bag path of travel.

A pair of nip pulleys 112, 113 are provided which engage the reaches 110, 111. The nip pulleys are selectively movable between nip and retracted positions in concurrent and opposite motions selectively to engage or release a bag.

The loaded bag 92 is moved through the sealing station 25 by the conveyors 90. The conveyors transport the loaded bag from the sealing station through a crimping and cooling station 96 to a discharge 140.

As the loaded bag enters the sealing station, a trimmer 120 trims the plastic above the conveyors 90 to the appropriate sealing height. With our presently preferred arrangement, approximately ⅛" of plastic remains above the conveyors 90. The loaded bag is then transported by the conveyer 90 past elongate hot air cartridge nozzles 201, 202 and 206, 207 which heat the plastic above the conveyors 90. The plastic almost reaches a thermo-molten state. The loaded bag is then moved through the crimping and cooling station 96 where it passes between a pair of crimp rollers 220, 221 to seal and cool the plastic thereby sealing the bag with a strong, wide seal and leaving no excess plastic. The loaded bag is then transported to the output conveyer 140.

Figure 2:
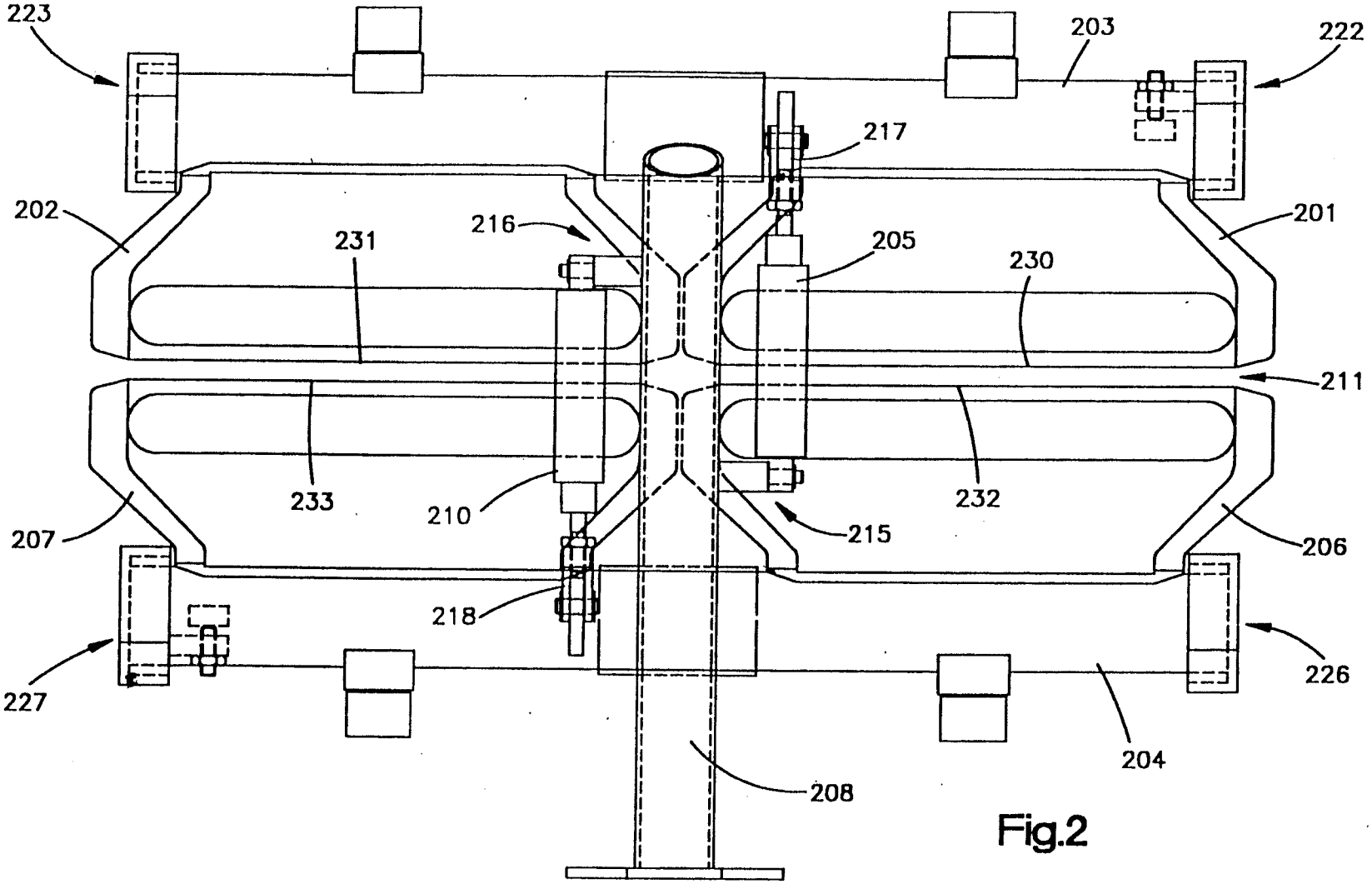
FIG. 2 is a top plan view of a portion of the sealing section of the machine.

Turning to FIG. 2, the hot air cartridges are comprised of pairs of hot air nozzles 201, 202 and 206, 207 respectively attached to elongate, cylindrically, contoured, cartridge tubes 203 and 204. The tubes 203, 204 are heat tubes which are rotatively supported by an air supply conduit 208. The conduit functions as a tube support structure journaling the tubes 203, 204 for rotation about their spaced and parallel axes.

Figure 3:
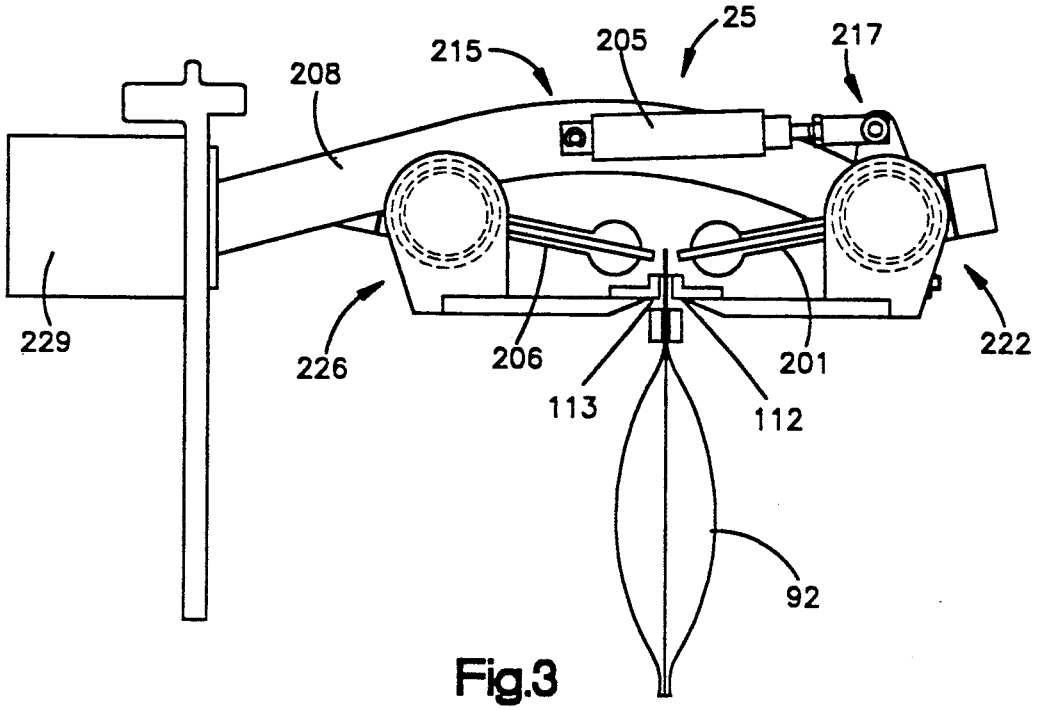
FIG. 3 is a side elevational view of the nozzles in their sealing position; and, FIG. 4 is a is a side elevational view of the nozzles in their storage position.
Figure 4:
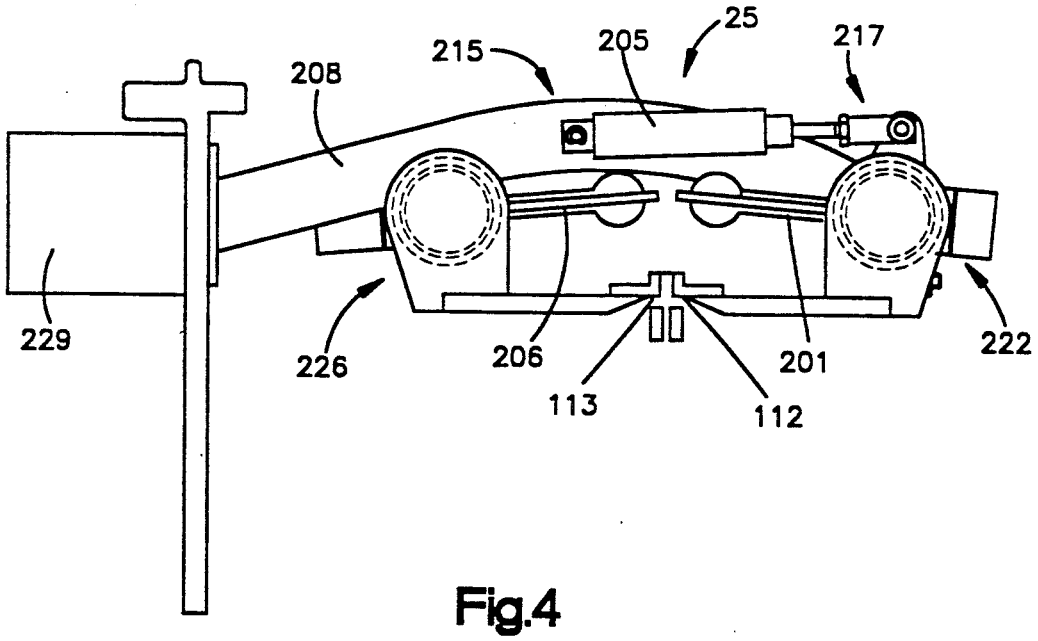

The tubes 203, 204 are capable of rotating between a sealing position as shown in FIG. 3 and a storage position as shown in FIG. 4. Air cylinders 205, 210 are provided for shifting the hot air cartridges between these two positions. The cylinders 205, 210 are pivotally connected to the conduit 208 at 215, 216 respectively. Arms 217, 218 are respectively connected to the tubes 203, 204. Ends of the cylinders 205, 210 remote from their connections 215, 216 are respectively, pivotally connected to the arms 217, 218. The ends are supported by tube support structure 222, 223 and 226, 227. On extension and contraction, the cylinders rotate the tubes 203, 204 respectively between the two positions. The rotation of the cartridge tubes 203, 204 moves the hot air nozzles 201, 202 and 206, 207 thereby properly positioning them either for sealing or for storage.

The air cylinders are controlled by open solenoids connected in series to the motor 80. When the motor 80 is in operation and bags are being fed through the machine and loaded, the solenoids close and the air cylinders 205, 210 place the hot air cartridges in the sealing position of FIG. 3 to seal the loaded bag. When the motor 80 is not in operation for any reason whatsoever, the solenoids open and the air cylinders 205 and 210 place the hot air cartridges in the storage position of FIG. 4 which blows the hot air emitted by the hot air nozzles 201, 202 and 206, 207 away from the belts of the conveyor 90 thereby minimizing heat damage to the belts and allowing the air to be kept at a constant temperature.

The air is supplied by the conduit 208 at low pressure from a pump 229 and is heated within the hot air cartridges. A thermocouple 211 is positioned near the outlet of one the nozzles. The thermocouple 211 senses the temperature of emitted air. Output signals from the thermocouple are fed to the controller 225. The machine controller (not shown) modulates the power supplied to electric resistance heaters (not shown) in the hot air cartridges to control the temperature of the air emitted from the nozzle outlets 230, 231 and 232, 233.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

We claim:

1. A method of packaging utilizing a chain of bags side to side interconnected by sets of frangible interconnections comprising:

a) cyclically feeding the chain along a path of travel;
b) slitting the bags along an upwardly oriented end;
c) with a first pair of belt conveyors grasping portions of the bags near their slit ends while leaving face and back lips projecting upwardly from the belts;
d) utilizing a plow to fold the lips outwardly in opposite directions from the path of travel respectively over the belts of the first pair;
e) capturing the folded lips between the belts of the first pair of conveyors and belts of a second pair of belt conveyors;
f) positioning the selected one of the bags at a load station;
g) inserting a product in the selected bag;
h) feeding the selected bag from the load station into a continuation of the path between belts of a continuously operating pair of belt conveyors;
i) securing the bag lips together, said securing step comprising:
   i) trimming the bag to the appropriate sealing height above the pair of belt conveyors;
   ii) feeding the loaded bag between at least one pair of hot air cartridges and blowing hot air onto it supplied by the hot air cartridges; and,
   iii) feeding the loaded bag between at least one pair of crimp rollers; and,
j) stopping the feed of bags and concurrently shifting the cartridges to a storage position.

2. A machine for packaging products using chains of interconnected bags comprising:

a) a bag supply conveyor assembly for transporting such interconnected bags from a supply to a load station and sequentially delivering bags one at a time and in an open condition to the load station;
b) bag opening means at the load station; and,
c) an output conveyor for sequentially transporting loaded bags along a bag closure path from the load station through a bag closure and thence to a discharge, the bag closure comprising:
   i) trimming means positioned adjacent the path for trimming the bag to the appropriate sealing height above a pair of belt conveyors;
   ii) at least one pair of hot air cartridges positioned on opposite sides of the path downstream from the trimming means;
   iii) cartridge shifting means operatively connected to the cartridges for shifting the cartridges from a storage position to a sealing position when the machine is operating and to the storage position when the machine is stopped; and,
   iv) at least one pair of crimping rollers located along the path and downstream from the hot air cartridges.

3. The machine of claim 2 wherein a drive is connected to the output conveyors for continuous operation when the output conveyors are in sue and the cartridge shifting means operates whenever it is started and when it is stopped.

4. The machine of claim 2 wherein the bag opening means includes structure for adjusting the relative position of pairs of bag openers in a selected spaced relationship appropriate for the size of bag to be delivered to the load station.

5. A sealing mechanism for use with a machine for packaging products wherein plastic bags are moved along a path of travel, the mechanism including:

a) trimming means positioned adjacent the path for trimming the bag to the appropriate sealing height above a pair of belt conveyors;
b) a pair of air cartridges positioned on opposite sides of the path downstream from the trimming means; and,
c) cartridge shifting means operatively connected to the cartridges for shifting the cartridges from a storage position to a sealing position when the machine is operating and to the storage position when the machine is stopped, the cartridges when in use and in the sealing position directing heated air to a sealing station along the path of travel and when in the storage position directing heated air away from and out of the path of travel.

6. The mechanism of claim 5 wherein a thermocouple is provided for controlling the temperature of the hot air emitted by the hot air cartridges.

7. A fusing mechanism defining a path of travel for fusing webs of thermo plastic material together at a fusing station comprising:

a) a pair of hot air cartridges disposed on opposite sides of the station; and, b) a cartridge shifting means operatively connected to the cartridges and adapted to shift the cartridges between a fusing position directing hot air toward the station and a storage position for directing hot air away from the station and a path of travel when the cartridges are in operation.

8. The mechanism of claim 7 wherein a thermocouple is positioned to sense the temperature of cartridge emitted air and wherein the thermocouple is adjusted to emit signals to effect control of the temperature of the air emitted by the air cartridges.

9. A fusing mechanism defining a path of travel for fusing webs of thermo plastic material together at a fusing station comprising:

a) a pair of hot air cartridges disposed on opposite sides of the station;

b) a cartridge shifting means operatively connected to the cartridges and adapted to shift the cartridges between a fusing position directing hot air toward the station and a storage position for directing hot air away from the station when the cartridges are in operation; and, c) at least one pair of crimp rollers located downstream from the station along a work transport path.

10. A method of fusing plastic in a packaging machine sealing station comprising:

a) heating air in a pair of heat tubes to an operating temperature;

b) blowing the heated air through a pair of hot air nozzles;

c) rotating the air nozzles from a storage position to a fusing position so that the heated air is blown into a path of travel for plastic through the sealing station;

d) feeding plastic along the path of travel through the sealing station;

e) rotating the air nozzles from the fusing position to the storage position whenever the feeding of plastic is interrupted so that the heated air is blown away from machine components and the path of travel; and, f) maintaining the operating temperature of the heated air while the nozzles are in the storage position.

11. A plastic fusing mechanism comprising:

a) a pair of elongate heat tubes;

b) tube support structure journaling the tubes for rotation about spaced and parallel axes;

c) a pair of elongate nozzles respectively connected to the heat tubes; and, d) a rotation means operatively connected to the nozzles to shift the nozzles from a fusing position wherein outlets of the nozzles are directed at a fusing station to a storage position wherein the outlets are directed away from the station and away from machine components and out of a product path of travel and from the storage position to the fusing position.

12. The mechanism of claim 11 wherein an air supply conduit is connected to the heat tubes to supply air to the tubes.

13. The mechanism of claim 11 wherein there are two pairs of nozzles.

14. A heat sealing mechanism comprising:

a) an elongate air supply conduit;

b) a pair of cylindrical heat tubes each rotatively supported by the conduit for rotation about spaced parallel axes, each of the tubes being supported at a longitudinally central portion;

c) two pairs of elongate nozzles, the nozzles of one pair being connected to a first of the tubes on opposite sides of its support and the nozzles of the other pair being connected to the second of the tubes on opposite sides of its support; and, d) first and second air cylinders respectively connected to the first and second tubes and to the conduit for shifting outlets of the nozzles between sealing and storage positions.

15. The mechanism of claim 14 wherein each cylinder to tube connection includes an arm connected to its associated tube.

16. A sealing mechanism for use with a machine for packaging products wherein plastic bags are moved along a path of travel, the mechanism including:

a) trimming means positioned adjacent the path for trimming the bag to the appropriate sealing height above a pair of belt conveyors;

b) a pair of air cartridges positioned on opposite sides of the path downstream from the trimming means;

c) cartridge shifting means operatively connected to the cartridges for shifting the cartridges from a storage position to a sealing position when the machine is operating and to the storage position when the machine is stopped; and, d) at least one pair of crimp rollers located along the path and downstream from the hot air cartridges.

* * * * *